United States Patent [19]

Ozawa

[11] 4,437,620

[45] Mar. 20, 1984

[54] METHOD AND APPARATUS FOR GATHERING RINGS OR WIRE RODS INTO COILS

[75] Inventor: Masaichi Ozawa, Kimitsu, Japan

[73] Assignee: Nippon Steel Corporation, Tokyo, Japan

[21] Appl. No.: 366,420

[22] Filed: Apr. 7, 1982

[30] Foreign Application Priority Data

Apr. 13, 1981 [JP] Japan ..... 56-55223

[51] Int. Cl.[3] ..... B21C 47/00

[52] U.S. Cl. ..... 242/83; 242/84

[58] Field of Search ..... 242/83, 82, 129, 81, 242/84; 140/1, 71 C; 19/159 R

[56] References Cited

U.S. PATENT DOCUMENTS

| | | | |
|---|---|---|---|
| Re. 25,477 | 11/1963 | Crum | 242/83 X |
| 1,122,812 | 12/1914 | Somerville | 242/84 X |
| 3,088,690 | 5/1963 | Haugwitz | 242/83 |
| 3,377,944 | 4/1968 | Hill | 242/83 X |
| 3,926,382 | 12/1975 | Sieurin et al. | 242/81 X |
| 4,251,037 | 2/1981 | Puchovsky | 242/83 X |
| 4,293,103 | 10/1981 | Tsukamoto | 242/83 |

*Primary Examiner*—Stuart S. Levy
*Assistant Examiner*—Scott J. Haugland
*Attorney, Agent, or Firm*—Wenderoth, Lind & Ponack

[57] ABSTRACT

Rings of wire rod are continuously dropped from a conveyor around a sail in a gathering tub to gather them together into coil form. A formed coil is delivered from the gathering tub to an adjacent down-ender. When a given quantity of rod rings has been coiled together, the sail is divided into two segments, and a first segment continues to gather together the rod rings continuously supplied from the conveyor into the next coil while a second segment carries the formed coil to the down-ender. Upon completing the delivery to the down-ender, the second segment returns to the original position where it combines with the first segment continuing coiling to make up the sail again. The first segment coils the rod rings while guiding them with at least three guides circumferentially spaced from each other.

7 Claims, 12 Drawing Figures

METHOD AND APPARATUS FOR GATHERING RINGS OR WIRE RODS INTO COILS

This invention relates to a method and apparatus for gathering rings of wire rods, continuously formed on a moving conveyor, into coils by allowing the rings to fall into a gathering unit or tub.

BACKGROUND OF THE INVENTION

To gather together the continuously conveyed rings of wire rod into coils, conventionally the wire rod 1 leaving the finishing mill 2 is cooled by a water cooler 2 and formed into continuous rings by a laying cone 4, thence the rings are conveyed by a conveyer 5 and dropped into a gathering tub 6, as illustrated in FIGS. 1 and 2.

Inside the gathering tub 6 is set a coil plate 8, shown in its highest position A-A in FIG. 2*b*, to receive each ring of the falling rod 1. The rings of the rod 1 are coiled around a rectangular pillar-like core, called a sail 7, vertically projecting through the center of the coil plate 8. As the rings of the rod 1 fall thereon, the coil plate 8 beings to descend until it eventually stops in the lowest position B-B.

When the piled up rings have reached a predetermined quantity, the wire rod 1 is cut to leave a separate coil 9 on the coil plate. As the sail 7 moves horizontally in direction H, the coil 9 is transferred from within the gathering tub 6 into a down-ender 14. When the coil 9 has been completely accommodated in the down-ender 14, the sail 7 descends and, then, moves empty, horizontally, back to the gathering tub 6 leaving the coil 9 in the down-ender 14. On completing the horizontal travel, the sail 7 rises into the original position shown in FIG. 2*b*.

The down-ender 14 tilts down, as indicated by the arrow D in FIG. 2*b*, and the coil 9 contained therein is placed in a horizontal position and pushed onto a hanger 15. Loaded on the horizontal bar of the hanger 15, the coil 9 is carried to a tying machine via an inspection process, both not shown. This rod-ring gathering and conveying method of the conventional type has some drawbacks as follows:

When the horizontal cross section of the sail is rectangular as shown in FIG. 2, the coil formed therearound tends to become elliptical rather than circular; i.e. the inside diameter becomes greater along the longer side of the sail than along the shorter side (see a plan view in FIG. 2*a*). This often leads to the jutting out of irregularly laid rings during tying or a failure in supplying circular coils demanded by users. Moving the sail itself for transferring a formed rod coil creates a considerable time lag before gathering the next coil of rod rings.

FIG. 3 is a graph that shows the condition of the inside diameter of wire rod coils made by the conventional method. While the aimed-for inside diameter is no smaller than 800 mm, in practice coils having an inside diameter smaller than 800 mm account for 12 percent of total coils produced.

Also, the descending sail 7 sometimes produces scratches on the internal surface of the coiled rods 9.

SUMMARY OF THE INVENTION

An object of this invention is to provide a method and apparatus for gathering together rings of wire rod into a coil which eliminate the drawbacks of the conventional method and apparatus by preventing the jutting out of rings from the formed coil, assuring the formation of circular coils, and permitting a lag-free formation of the next coil.

Another object of this invention is to provide an apparatus that gathers together rings of wire rod into a coil without producing scratches on the internal surface of the coiled rods.

In order to achieve the aforementioned objects, the rod-coil forming apparatus of this invention continuously drops rings of wire rod from the conveyor around a sail in a tub to gather them into a coil, which is then delivered to an adjacent down-ender. The delivery to the down-ender is effected when the rings gathered on the sail have reached a predetermined quantity. The sail is separated into two segments. While a first segment is gathering together the rings of wire rod continuously supplied, a second segment transfers the formed coil into the down-ender. Upon completion of the transfer, the second segment returns to its original position to join the first segment, making up the sail again. In forming a coil, the first segment guides the falling rings of wire rod with at least three rod-ring quides separated from each other circumferentially.

To effectively implement the method just described, the rod-ring coiling apparatus according to this inventions comprises a conveyor to carry forward rings of wire rod, a gathering tub at the delivery end of the conveyor, an elevatable sail disposed inside the gathering tub to receive the rings of wire rod supplied therearound, a drive unit to raise and lower the sail, a drive unit to horizontally move the sail, and a down-ender on the delivery side of the gathering tub. The sail consists of an elevatable first segment and a second segment that is adapted to move both vertically and horizontally. The first segment has at least three rod-ring guides spaced from each other circumferentially. The second segment carries a completed coil over to the down-ender.

This dividable sail allows the horizontal transfer of a completed coil without delaying the formation of the next coil and dose not require any major modification of the conventional apparatus. According to the conventional method, the rings of wire rod continuously supplied are allowed to pile up on the coil plate even while the sail is out of its position moving horizontally to the down-ender. This has constituted one of the causes of non-circular coils. According to the invention the sail is divided into a first segment that chiefly performs the gathering of rod rings and a second segment that mainly undertakes the transfer of formed coils. As the second segment horizontally moves outside the gathering tub carrying a formed coil, the first segment rises into position to permit continued orderly ring gathering, thereby precluding the formation of non-circular coils.

DETAILED DESCRIPTION OF THE PREFERRED EMBODIMENTS

Figure 4A:
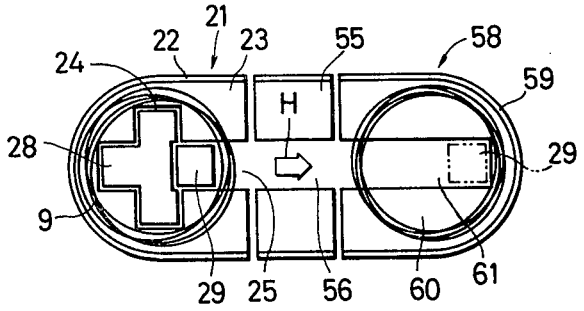
FIGS. 4(*a*) and (*b*) are a plan and a front view showing an embodiment of the apparatus for gathering together rings of wire rod according to this invention.

FIG. 4 shows an embodiment of the rod ring gathering apparatus according to this invention.

A gathering tub 21 is provided at the delivery end of a conveyor 5. The gathering tub 21 has a wall 22, U-shaped in cross section, that opens in the direction in which a coil 9 of wire rod is moved out of the gathering tub (to the right in FIG. 4). Rings 1 of wire rod are gathered together within this wall 22. Within the wall 22 is elevatably provided a horizontal coil plate 23. The coil plate 23 has an opening 24 through which a sail passes and a passage 25 horizontally therethrough opening out of the delivery side, i.e. to the right in FIG. 4.

To the coil plate 23 is connected a chain 65 that is passed over upper and lower chain wheels 66 and 67 disposed next to the gathering tub 21. The lower chain wheel 67 is driven by a motor 68. Photodetectors 69 and 70 are provided above and below a suitable level L to detect the top surface of the rod coil 9.

A sail 27 extends through the opening 24 in the coil plate 23. The sail 27 consists of a T-shaped cross-section main segment 28 and an I-shaped cross-section laterally movable segment 29 which together form a cross-like shape when viewed in horizontal cross section. The distance across the sail 27 is somewhat smaller than the inside diameter of the rod coil 9 to be formed therearound. The rod rings 1 are gathered together between the wall 22 and the sail 27. The T-shaped segment 28 passes through the opening 24 and the I-shaped segment 29 through the passage 25.

A stationary frame 31 and a movable frame 41 are disposed directly under the wall 22.

The stationary frame 31 comprises a column 32 and a beam 33 horizontally extending from the lower end of the column 32. A hydraulic piston-cylinder device 35 is mounted on the beam 33 by a pin 34. The rod 36 of the hydraulic piston-cylinder device 35 is connected to the T-shaped segment 28. A guide roller 37 guided along the column 32 is attached to the lower part of one side of the T-shaped main segment 28 so that main segment 28 is movable only vertically.

Similarly, a hydraulic piston-cylinder device 45 is connected through a pin 44 to the beam 43 of the movable frame 41. The rod 46 of the hydraulic piston-cylinder device 45 is connected to the I-shaped segment 29. The I-shaped segment 29 is guided, by quide rolls 47 attached thereto, along the column 42 of the movable frame 41 so as to be movable vertically. Guide rolls 48, attached to the upper part of the column 42, guide movable frame 41 along a girder 49 horizontally extending from under the wall 22 to under a down-ender 58 described next. A traversing hydraulic piston-cylinder device 51 is disposed below the down-ender 58. The rod 52 of the hydraulic piston-cylinder device 51 extends along the girder 49, with the forward end connected to a point midway on the column 42 of the movable frame 41, and when the piston-cylinder device 51 is operated, the segment 29 is moved laterally while the vertical orientation is maintained.

An adjoining intermediate plate 55 is disposed on the delivery side of the gathering tub 21. The intermediate plate 55 is at the same level as the coil plate 23 in its lowest position and has a passage 56 at the center through which the I-shaped segment 29 passes.

The down-ender 58 adjoins the intermediate plate 55 on the delivery side thereof. The down-ender 58 has a wall 59, shaped like the wall 22 of the gathering tub 22, with an opening on the entry side. To the lower end of the wall 59 is fastened a coil plate 60 having a passage 61 through the center.

The following paragraphs describe a method of gathering together rings of wire rods using the apparatus just described.

When the rod rings 1 have been gathered around the cross-shaped sail 27, the sail 27 is divided into the T-shaped segment 28 and the I-shaped segment 29. Guided along the column 32 by the guide rollers 37 the T-shaped segment 28 descends by the action of the piston-cylinder device to directly under the coil plate 23 (at B-B in FIG. 4). Then, the I-shaped segment 29 carrying the coil 9 is guided by the traversing hydraulic piston-cylinder device 51 along the girder 49 by the guide rollers 48, from within the gathering tub 21 to the inside of the down-ender 51. During this travel, the I-shaped segment 29 passes through the passages 25, 56 and 61. When the coil 9 has been accommodated in the down-ender 58, the I-segment 29, for being unloaded, is guided down along the column 42 by the guide rollers 47 by the elevation hydraulic piston-cylinder device 45, and then, upon reaching the lowest position, horizontally back toward the gathering tub 21 by the traversing hydraulic piston-cylinder device 51.

Figure 4B:
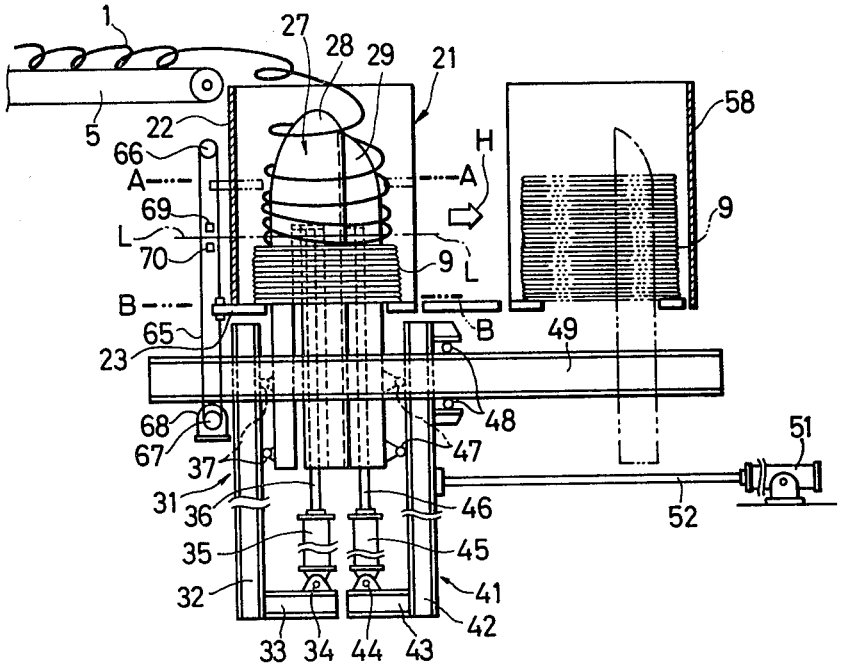

Once inside the gathering tub again, the I-segment 29 is raised by the action of the elevation hydraulic piston-cylinder device 45, to join the T-shaped segment 28 again as shown in FIG. 4*b*. Meanwhile, the T-shaped segment 28 is raised by the elevation hydraulic piston-cylinder device 35, to start gathering the next coil immediately after the coil 9 on the I-shaped segment 29 has completely left the gathering tub 21. Therefore, the T-shaped segment 28 is forming the next coil when the I-shaped segment 29 returns to join the T-shaped segment again.

The coil 9 is formed at a constant level L. When the top of the coil 9 rises above the photodetector 69, the motor 68 drives the chain 65 to increase the lowering speed of the coil plate 23. In the opposite case, the lowering speed of the coil plate 63 is decreased.

Figure 1:
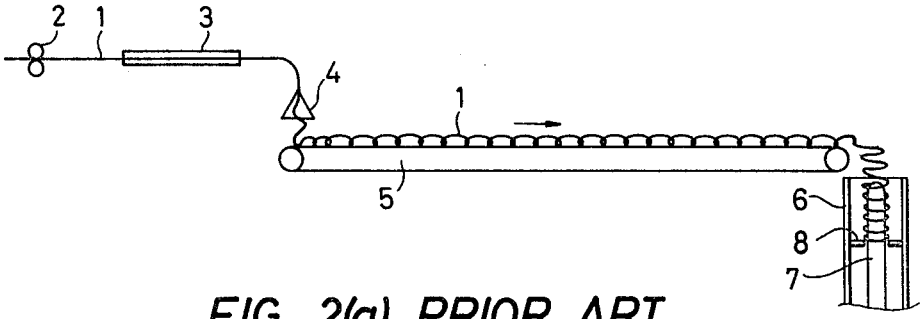
FIG. 1 PRIOR ART
FIG. 1 illustrates an example of the conventional method of gathering together rings of wire rod.
Figure 2A:
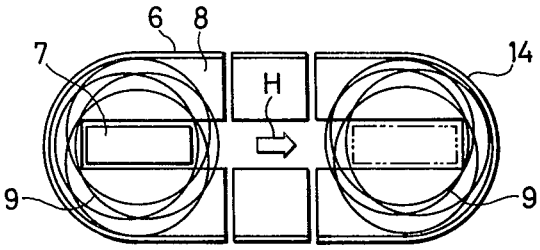
FIG. 2(a) PRIOR ART
FIGS. 2(*a*) and (*b*) are a plan and a front view showing an example of the conventional apparatus for gathering together rings of wire rod.
Figure 2B:
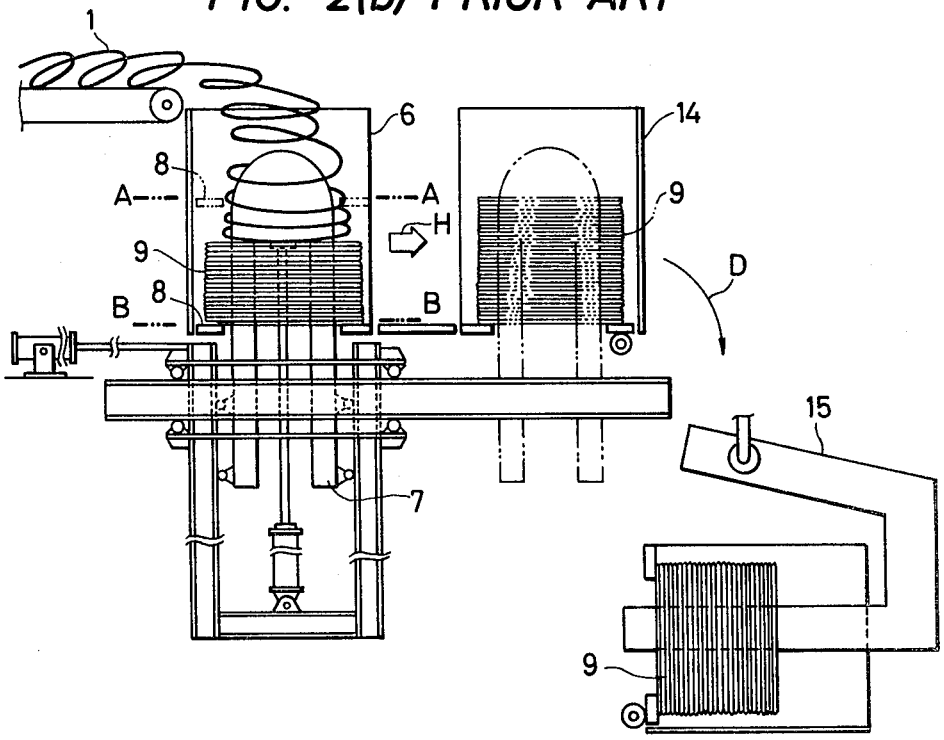
FIG. 2(b) PRIOR ART
Figure 3:
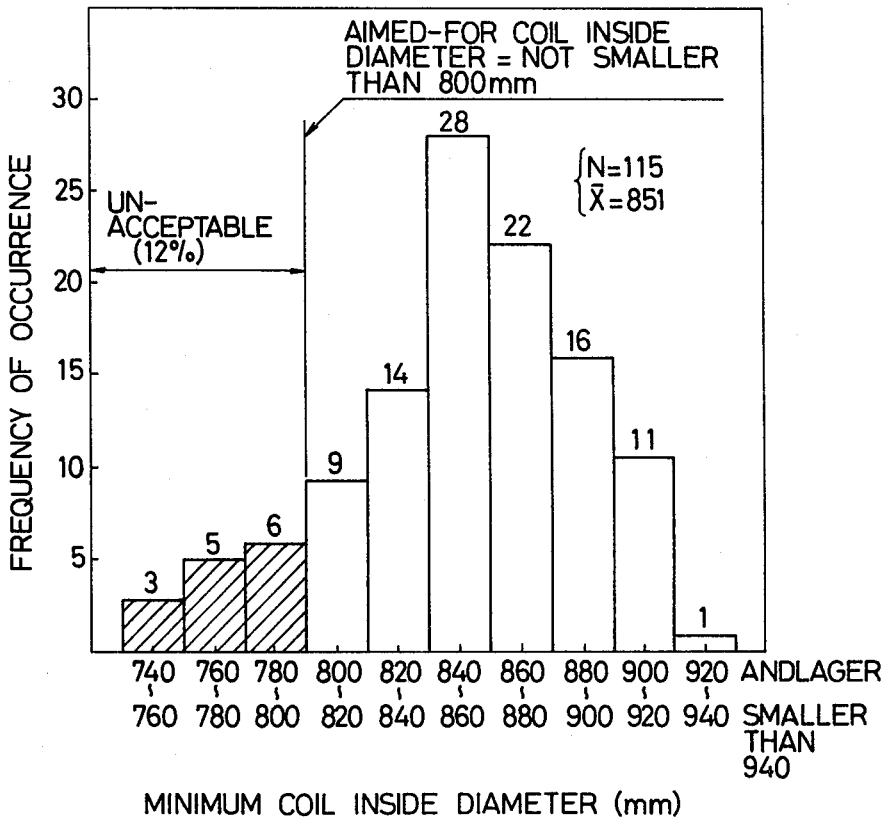
FIG. 3 PRIOR ART
FIG. 3 is a graph that shows the condition of the inside diameter of wire rod coils made by the conventional method.
Figure 5:
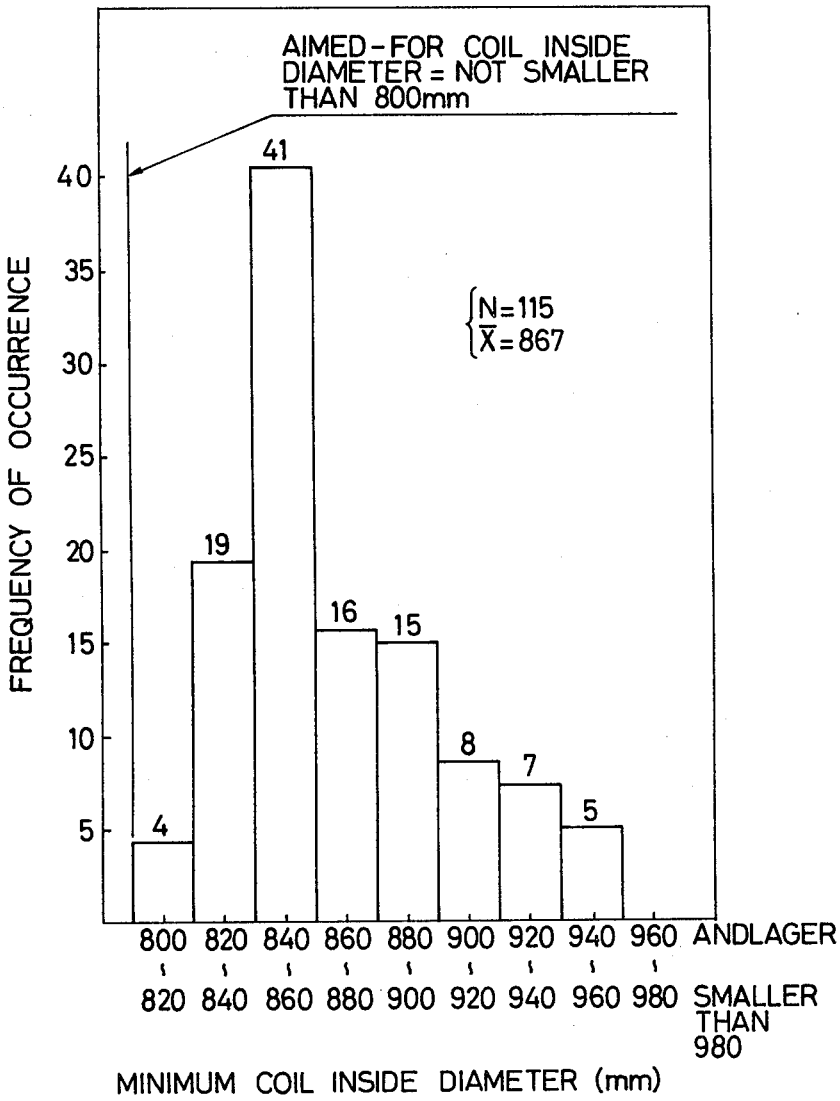
FIG. 5 is a graph similar to FIG. 3 that shows the condition of the inside diameter of wire rod coils made by the method of this invention.

FIG. 5 graphically shows the condition of the inside diameter of wire rod coils made by the method and apparatus of this invention. On the average, the inside diameters shown here are larger than in FIG. 3, with none falling short of 800 mm.

As evident from the above, the rings of wire rod continuously gathered together according to the method and apparatus of this invention invariably form coils of a constant minimum inside diameter.

Figure 6A:
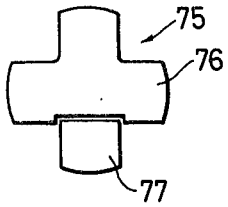
FIGS. 6(*a*), 6(*b*) and 6(*c*) are cross-sectional views of different sails embodying the principle of this invention.
Figure 6B:
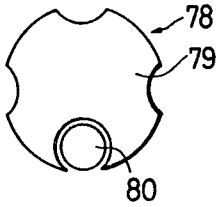
Figure 6C:
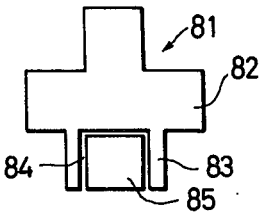

This invention is by no means limited to the preferred embodiments described hereinabove. For example, the sail may be designed to have a different horizontal cross-section. The sail 75 shown in FIG. 6(*a*) consists of a first segment 76 and a second segment 77, the external side of each projection forming a convex surface. The sail 78 in FIG. 6(*b*) consists of a substantially cross-shaped first segment 79 with convex sides and a cylindrical second segment 80. Because of the convex sides, these sails can easily form coils resembling a true circle in shape, without damaging the rod being coiled. The sail 81 in FIG. 6(*c*) consists of a first segment 82 having a guide 83, in which a vertical guide groove 84 is formed, and a second segment 85 that moves in the guide groove 84.

Figure 7A:
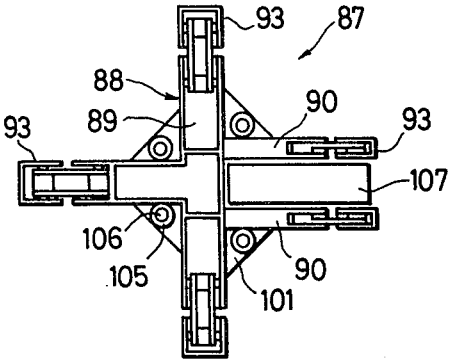
FIG. 7(*a*) is a plan view, and FIG. 7(*b*) is a side elevation showing the lower section of another embodiment of the sail.
Figure 7B:
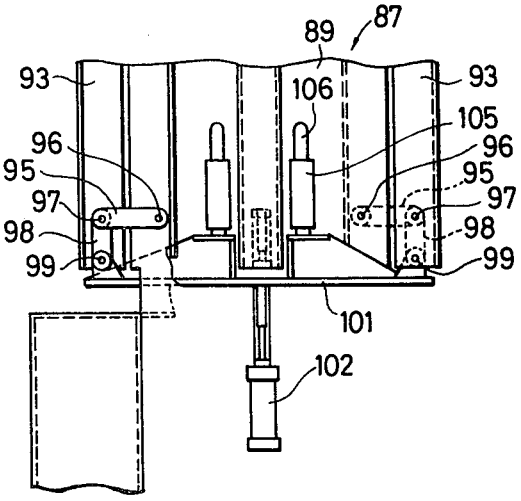

FIG. 7 shows still another sail. A first segment 88 of the sail 87 consists of a frame-like main body with a cross-shaped cross-section having three arms 89 at 90° from each other and two arms 90 spaced from each other and forming the fourth part of the cross, and bars 93 at the ends of each arm 89 and 90 that engage the internal surface of a wire rod coil.

The bars 93 each extend vertically along, and in the proximity of, the arms 89 and 90. Each bar 93 is connected to the corresponding arm 89 or 90 by several first links 95 that are vertically spaced from each other. One end of each first link 95 is attached to the arm 89 by a pin 96 and the other end thereof to the bar 93 by a pin 97.

A base 101 is elevatably disposed near the bottom of the main body. One end of each of a plurality of second links 98 is connected by a pin 99 to the edge of the base 101. The other end of each second link 98 is connected to the pin 97 coupled to one of the first links 95 positioned close to the bottom of the corresponding bar 93. A hydraulic piston-cylinder device 102 is attahced to the base 101 to move it up and down. Cylindrical guides 105 are fastened to the main body. The base 101 moves up and down along the guides 105 on rods 106 projecting from the top surface thereof and extending through guides 105.

As in the embodiments described previously, a second segment 107 is provided separate from the first segment 88. When gathering rod rings, the second segment 107 is contained between arms 90 of the main body of the first segment 88.

While rod rings are being gathered together, the base 101 is held in the raised position by means of the hydraulic piston-cylinder device 102. At this time, each bar 93 is moved outwardly away from the corresponding arm 89 or 90 by the action of the links 95 and 98, thereby making the distance across the sail 87 larger. When a given quantity of rod rings has been gathered together, the sail 87 descends. Immediately before this descent, the hydraulic piston-cylinder device 102 lowers the base 101, whereby the links 95 and 98 cause the bars 93 to move horizontally toward the main body, thereby reducing the distance across the sail 87. This leaves a clearance between the bars 93 and the internal surface of the rod coil which is large enough to preclude the occurrence of scratches on the rod surface that might result from the contact therebetween.

Although not illustrated, a collapsible bar similar to the bars 93 of the first segment 88 may also be provided on the second segment 107.

What is claimed is:

1. A method of gathering together rings of wire rod into a coil comprising:

dropping continuously supplied rings of wire rod from the delivery end of a conveyor around a sail in a gathering tub positioned beneath the delivery end of the conveyor and having a lateral side open, the sail having a vertically extending main segment movable only up and down in said tub and a laterally movable vertically extending segment movable from an original position adjacent the main segment both up and down and laterally while maintaining its vertical orientation; and after a given quantity of rod rings has been gathered on the sail to form the coil, lowering the main segment while keeping it vertically oriented to a level where the top thereof is below the coil, moving the laterally movable segment laterally through the lateral open side of the tub while maintaining its vertical orientation to a down-ender positioned adjacent the sail, moving the main segment up while maintaining its vertical orientation to the initial position for immediately starting to gather the continuously supplied rod rings into the next coil, lowering the laterally movable segment in the down-ender for removing it from the formed coil, and while in the lower position, moving it laterally to a position beneath the original position and then raising the laterally movable segment to the original position to make up the complete sail again, all the while maintaining the laterally movable segment in its vertical orientation, and while continuing to gather falling rod rings into the next coil.

2. An apparatus for gathering together rings of wire rod into coils, which comprises:

a gathering tub adapted to be positioned beneath the delivery end of a rod-ring conveying means and having one lateral side open;

a sail in said tub for receiving the rod rings therearound, said sail having a vertically extending main segment movable only up and down in said tub, and a vertically extending laterally movable segment movable both up and down and laterally while maintaining its vertical orientation from a position adjacent said main segment to a position spaced away from said main segment through the laterally open side of said tub;

means connected to said main segment for moving said main segment only up and down; and further means connected to said laterally movable segment for moving said laterally movable segment both up and down and laterally in both the raised and lowered positions of said laterally movable segment.

3. An apparatus as claimed in claim 2 further comprising a down-ender positioned adjacent said tub at said position spaced from said main segment and to which said laterally movable segment is movable in the lateral movement thereof.

4. An apparatus as claimed in claim 2 in which said main segment has a plurality of vertically extending rod guides spaced circumferentially from each other.

5. An apparatus as claimed in claim 4 in which each of said rod guides has a vertically extending bar extending along the rod guide, a base member adjacent the bottom of said main segment and movable up and down relative to said main segment, and a linkage connected between each of said bars and said base member for, when said base member is moved from a first vertical position to a second vertical position, moving said bars outwardly and parallel to said rod guides for holding a coil of rod rings by engaging the inner circumference of the coil, and when said base member is moved from said second vertical position to said first vertical position, moving said bars inwardly parallel to said rod guides for disengaging said bars from the inner circumference of said coil and freeing the coil for removal of said main segment from within the coil.

6. An apparatus as claimed in claim 4 in which said main segment is substantially T-shaped in horizontal cross-section with the crossing bar of the T and the vertical part of the T forming said rod guides, and said laterally movable segment has a substantially I-shaped horizontal cross-section, and when said laterally movable segment is adjacent said main segment, the horizontal cross-sectional shape of the sail is substantially cross-shaped.

7. An apparatus as claimed in claim 6 in which said main segment has a vertical groove opening toward the laterally open side of said tub and in which said laterally movable segment is guided in lateral movement when close to said main segment.

* * * * *